US009856676B2

(12) United States Patent
Leontaridis

(10) Patent No.: US 9,856,676 B2
(45) Date of Patent: Jan. 2, 2018

(54) EXTERNAL LOCK ASSEMBLY WITH A PAIR OF LOCKING BOLT MEMBERS FOR SLIDING DOORS OR WINDOWS INCORPORATING AN IMMOBILIZER DEVICE OF AT LEAST ONE LOCKING BOLT MEMBER AT LOCKED CONDITION

(71) Applicant: Athanasios Leontaridis, Kallithea (GR)

(72) Inventor: Athanasios Leontaridis, Kallithea (GR)

(73) Assignee: CAL-TECH INTERNATIONAL INC, Sunny Isles Beach, FL (US)

( * ) Notice: Subject to any disclaimer, the term of this patent is extended or adjusted under 35 U.S.C. 154(b) by 0 days.

(21) Appl. No.: 15/065,314

(22) Filed: Mar. 9, 2016

(65) Prior Publication Data

US 2016/0265252 A1 Sep. 15, 2016

(30) Foreign Application Priority Data

Mar. 9, 2015 (GR) ..... 20150100123

(51) Int. Cl.
*E05B 17/20* (2006.01)
*E05B 35/00* (2006.01)
(Continued)

(52) U.S. Cl.
CPC ..... *E05B 17/2034* (2013.01); *E05B 15/0053* (2013.01); *E05B 35/008* (2013.01); *E05B 65/087* (2013.01)

(58) Field of Classification Search
CPC ..... E05B 15/0053; E05B 17/2007; E05B 17/2034; E05B 35/008; E05B 65/087; E05B 65/0864; E05B 65/0811; E05B 67/383
(Continued)

(56) References Cited

U.S. PATENT DOCUMENTS 1,970,653 A * 8/1934 Hendrix ..... E05D 13/06 292/74
2,447,219 A * 8/1948 Vanderveld ..... E05B 65/0811 292/46
(Continued)

FOREIGN PATENT DOCUMENTS

CN 202899823 U 4/2013
EP 952284 A1 10/1999
(Continued)

OTHER PUBLICATIONS

Search Report issued on GR Application No. 20150100123 dated May 26, 2016 with English translation; 3 pages.

*Primary Examiner* — Suzanne Barrett
(74) *Attorney, Agent, or Firm* — Ming Chow; Senorica, LLC

(57) ABSTRACT

An external lock assembly for sliding doors or windows comprising a pair of reciprocatingly moving sliding bolt carriage handle members (8*a*, 8*b*) that move locking bolt members (7*a*, 7*b*) and a pair of associated guide blocks (18*a*, 18*b*) fixedly mounted onto the body (12) of the lock assembly. At least one of the guide blocks is provided with a recessed region (20) adapted to accomodate an immobilizer member (21) that maintains at least one corresponding locking bolt member at locked condition. The immobilizer member (21) is pivotally mounted with a bottom extending shaft (22) that enters into a hole (20*a*) of the recessed region (20) and comprises a V-section body extension with adjacent sides (23*a*, 24*a*) and extreme edges (23, 24) respectively, while a slot (21*a*) of the immobilizer member (21) is adapted to receive a key implement (30) by means of which it is being rotated through a predetermined arc to bring one of the extreme edges (23, 24) thereof in abutment with a bottom end of a V-sectioned body portion (26) of the guide block
(Continued)

thereby providing an immobilized status of the associated locking bolt member at a locked condition.

3 Claims, 4 Drawing Sheets

(51) Int. Cl.
*E05B 65/08* (2006.01)
*E05B 15/00* (2006.01)

(58) Field of Classification Search
USPC ..... 70/90, 95, 97
See application file for complete search history.

(56) References Cited

U.S. PATENT DOCUMENTS 2,575,465 A * 11/1951 Patton ..... E05B 63/24 292/207
2,668,069 A * 2/1954 Grizzard ..... E05B 65/0811 292/1
2,668,071 A * 2/1954 Adams ..... E05B 65/0811 292/129
2,730,393 A * 1/1956 Ries ..... E05B 65/0811 292/244
2,769,330 A * 11/1956 O'Connell ..... E05B 65/087 292/153
2,783,635 A * 3/1957 Sterling ..... E05B 65/0811 292/124
2,810,284 A * 10/1957 Wartian ..... E05B 65/0811 292/124
2,990,208 A * 6/1961 Miller ..... E05B 65/087 292/165
3,040,555 A * 6/1962 Wartian ..... E05B 65/0811 292/106
3,390,557 A * 7/1968 Erickson ..... E05B 65/087 292/140
3,433,036 A * 3/1969 Brasseur ..... E05B 65/0811 292/126
4,024,739 A * 5/1977 Kaufman ..... E05B 65/087 292/108
4,457,146 A * 7/1984 Weinerman ..... E05B 65/0811 292/216
4,480,862 A 11/1984 Fleming
4,514,996 A * 5/1985 Sjogren ..... E05B 65/087 292/147
4,840,050 A * 6/1989 Gotanda ..... E05B 47/0046 292/169.13
5,390,516 A * 2/1995 Alchin ..... E05B 65/0835 292/129
5,561,994 A * 10/1996 Smith ..... E05C 9/041 292/39
5,934,719 A 8/1999 Athanasios
6,050,617 A * 4/2000 Prevot ..... E05B 63/0069 292/107
6,106,032 A * 8/2000 Och ..... E05B 51/02 292/195
6,247,341 B1 * 6/2001 Prevot ..... E05B 63/0069 292/DIG. 46
6,327,879 B1 * 12/2001 Malsom ..... E05B 65/0811 292/197
7,000,955 B2 * 2/2006 Heyder ..... E05B 13/00 292/159
7,942,027 B1 * 5/2011 Cassini ..... E05B 13/004 292/100
2007/0200370 A1 * 8/2007 Reithmeyer ..... E05B 63/18 292/340
2013/0152647 A1 * 6/2013 Terei ..... E05B 57/00 70/357
2014/0265360 A1 9/2014 Elias et al.

FOREIGN PATENT DOCUMENTS

GB 2304368 A 3/1997
GR 1002493 B 12/1996
GR 1002720 6/1997
GR 990100362 A 6/2001

* cited by examiner

EXTERNAL LOCK ASSEMBLY WITH A PAIR OF LOCKING BOLT MEMBERS FOR SLIDING DOORS OR WINDOWS INCORPORATING AN IMMOBILIZER DEVICE OF AT LEAST ONE LOCKING BOLT MEMBER AT LOCKED CONDITION

The current application claims a foreign priority to application number 20150100123 filed on Mar. 9, 2015 in Greece.

THE FIELD OF THE ART

The invention relates to the field of the art of locksmiths and in particular it relates to external lock assemblies appropriate for sliding door or window sash panels. The external lock assembly of the present invention is provided with a pair of locking bolt members and is characterized in that it is provided with a key device that securely locks at least one of the locking bolt members in a locked condition, i.e. in a condition wherein the door or window is closed and the two locking bolt members have entered within a tubular receiving member mounted onto a frame member surrounding the sliding sash.

THE BACKGROUND OF THE INVENTION

U.S. Pat. No. 5,934,719 has disclosed an external lock assembly for sliding door or window panels comprising a body member fixedly mounted onto a vertically extending side of the sliding sash and a tubular bolt receiving member fixedly mounted onto an opposing vertically extending frame member, wherein the body member is an elongate Π-section profile member, rectilinear channels being defined along the interior elongate lateral sides of the Π-section profile member, locking mechanisms comprising sliding bolt carriage handle members and cooperating guide blocks inserted through the ends of the Π-section profile member and adapted to slide within the rectilinear channels thereof, a pair of coaxially aligned tubular members with an intermediate gap extending at one elongate side of the Π-section profile member, said coaxially aligned tubular members being adapted to receive the bolt locking members of the sliding bolt carriage handle members and said intermediate gap being configured to receive the tubular receiving member that is mounted onto the vertically extending frame member when the vertically extending side of the sliding sash is brought in abutment with the vertically extending frame member whereby the tubular receiving member is coaxially aligned with the pair of coaxially aligned tubular members of the Π-section profile member and, consequent to a sliding of the sliding bolt carriage handle members, a locked condition of the lock assembly is being attained as the bolt locking members are inserted within this tubular receiving member. The lock assembly disclosed in U.S. Pat. No. 5,934,719 has provided a secure locking performance and it has further provided a reliable solution for mounting within the limited space available in between a pair of sliding door panels, as the case is with door or window assemblies comprising one glass and one shutter panel.

The application of the lock assembly disclosed in U.S. Pat. No. 5,934,719 has averted burglary, since it has proved very difficult to violate this lock assembly using coventional burglary tools, such as crowbars. Thus, burglars have been forced to seek new imaginative burglary methods and one of these methods is the cutting of a portion of the sliding sash profile in order to gain access in the interior and attempt to slide to a releasing condition the pair of locking bolts used in the lock assembly. Whilst the time that the burglar needs to spend in order to perform this process already deters him from selecting to violate a door/window locked with this lock assembly comprising the pair of locking bolt members, it is yet important to provide improvements in this type of lock assembly that would avert burglary attempts through applying the abovementioned process of cutting of a portion of the sliding sash profile in order to gain access in the interior.

With a scope of realizing the abovementioned improvement, the present invention proposes the provision of a device adapted to perform immobilization of at least one of the locking bolts of the external lock assembly at the locked position and of a key implement adapted to initiate such immobilization and release, thereby providing an enhanced security of the external lock assembly of the invention, since even if a burglar cuts through the sash and attempts to enter a hand in an interior position facing the lock assembly it will prove yet difficult and by all means an extra time consuming process to manage to drive a key or other appropriate implement (screwdriver, knife or lamina) through the slot provided for the introduction of the specific to this operation key implement and given the limited space in between a pair of sliding door panels it will also be extremely inconvenient, if not impossible, to orient the key or other implement perpendicularly into the slot, i.e. at the orientation required for effecting an appropriate operation thereof.

It is therefore evident that the security offered by the lock assembly of the invention is thus enhanced.

It should further be noted that the employment of the device adapted to perform immobilization of at least one of the locking bolts of the external lock assembly at the locked position and of a key implement effecting the immobilization and release is also critically important for averting unathorized unlocking of the lock assembly by young children or elderly suffering from dementia and related diseases.

SUMMARY OF THE INVENTION

It is the object of the present invention to provide an enhanced security against burglary and avert unauthorized use of an external lock assembly comprising a pair of locking bolt members for sliding doors or windows through incorporating of a device adapted to perform immobilization of at least one of the locking bolt members at the locked condition, i.e. at the condition where the sash is closed, the tubular receiving member mounted onto the frame has been brought in a position of alignement with the tubular members provided along an elongate side of the body of the lock assembly that is mounted onto the sash and the two locking bolt members have been driven through the tubular members of the lock assembly into the tubular receiving member of the frame thereby resulting in the vertically extending side of the sash being adhered to the opposing vertically extending side of the frame.

The external lock assembly of the invention is thus configured to include at least one immobilizer member for effecting immobilization of at least one of the locking bolt members at a locked condition, such immobilizer member being devised through an appropriate configuration of the guide block of the lock assembly so that it may accomodate the immobilizer member that is alternatively set at a position to provide an immobilized condition of at least one of the bolt locking members or a released condition of the same consequent to rotation of a key implement inserted through a hole of the covering plug of the lock assembly into an underlying slot of the immobilizer member.

BRIEF DESCRIPTION OF THE DRAWINGS

The invention will be made apparent to those skilled in the art by reference to the accompanying drawings in which.

DETAILED DESCRIPTION OF PREFERRED EMBODIMENTS

An illustrative embodiment of the lock assembly of the invention that comprises means of securely immobilizing at least one of the sliding bolt locking members whilst the latter has been brought at locked condition will be presented hereinbelow.

Figure 1:
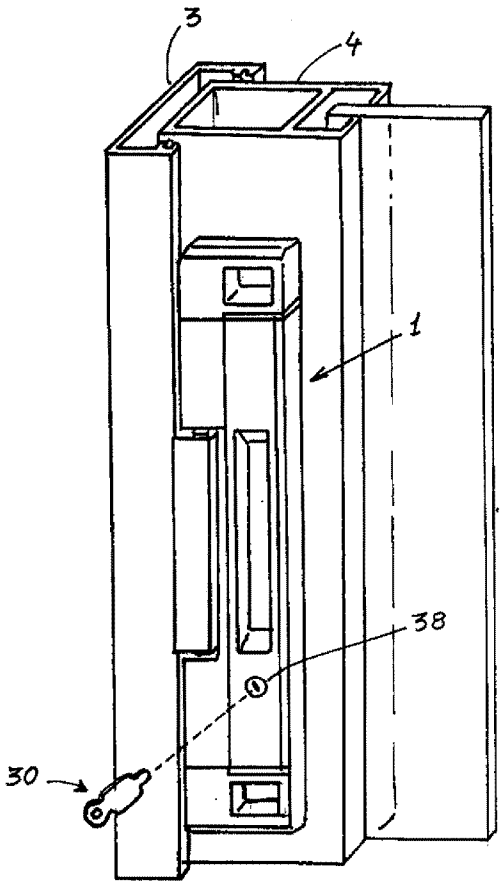
FIG. 1 shows a perspective view of a locked condition of the external lock assembly of the invention that comprises an elongate body with a pair of bolt locking members mounted onto a vertically extending side of the sash in a typical sliding door or window, wherein the sash has slided in abutment with the frame and the bolt locking members are brought in engagement condition through insertion within a tubular bolt receiving member mounted onto an opposing vertically extending side of the frame.
Figure 2:
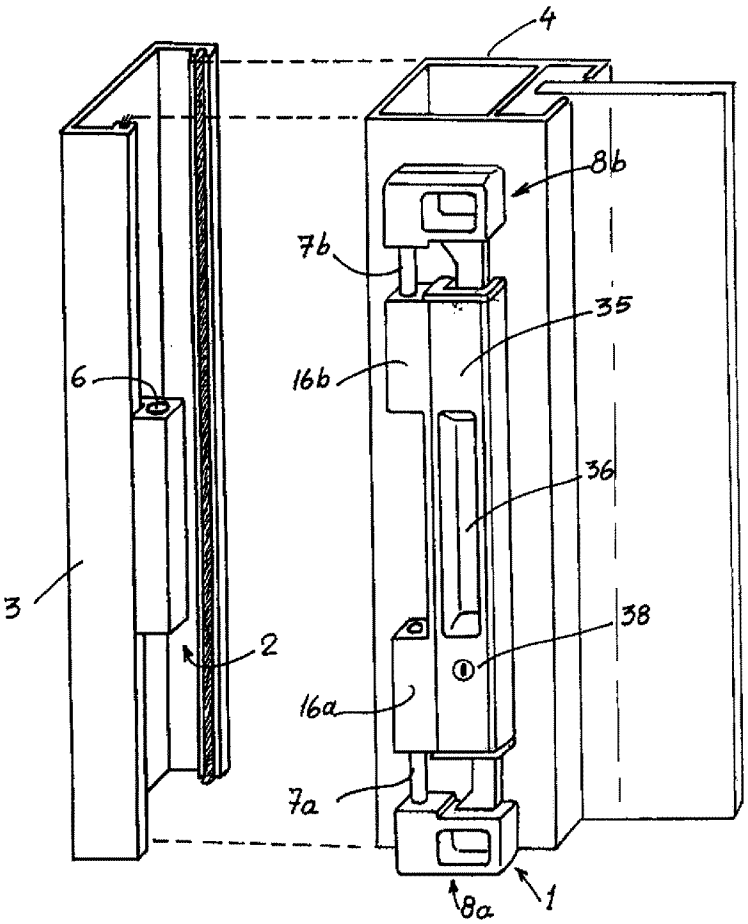
FIG. 2 shows a perspective view of an unlocked condition of the external lock assembly of the invention wherein the bolt locking members have slided out of the tubular receiving member and the sash has slided away from the frame.

The lock assembly of the invention is shown in a locked and an unlocked condition in FIG. 1 and in FIG. 2 respectively and is adapted to be used in sliding door or window panels with a sliding sash member 4 and a frame member 3. The lock assembly is particularly applicable in sash and frame profile systems made from aluminum or plastics or other material.

Figure 3:
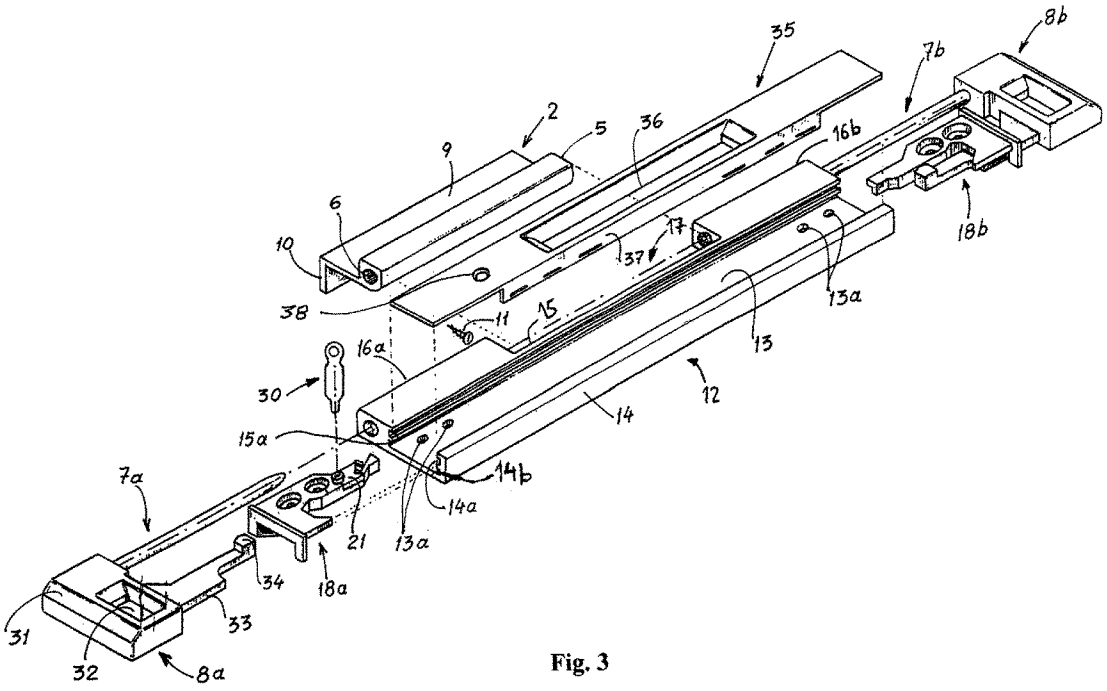
FIG. 3 shows in perspective an exploded view of the external lock assembly of the invention including the tubular bolt receiving member thereof.

As shown in the exploded view of FIG. 3, the lock assembly 1 of the invention comprises a body member 12 being configured as an elongate profile member with a base 13 and parallel lateral sides 14 and 15, wherein an arrangement of holes 13*a* is provided close to the ends of the base 13 and appropriate screws are employed to be driven through these holes 13*a* for fixedly mounting the body member 12 onto a vertically extending side of the sash member 4.

A bolt receiving member 2 adapted to cooperate with the lock assembly 1 is accordingly fixedly mounted onto an opposing vertically extending frame member 3. Rectilinear channels 14*a* and 15*a* are provided along the interior elongate lateral sides 14, 15 of the elongate profile member respectively, such rectilinear channels 14*a*, 15*a* being adapted to receive locking mechanisms comprising sliding bolt carriage handle members 8*a*, 8*b* adapted to slide within the rectilinear channels 14*a*, 15*a* thereof with a scope of enabling a locked or unlocked condition of the lock assembly in cooperation with corresponding guide blocks 18*a*, 18*b* inserted through the ends of the elongate profile member and fixedly mounted onto the base 13 thereof.

Coaxially aligned tubular members 16*a*, 16*b* with an intermediate gap 17 in between them extend along a longitudinal side of the elongate profile member facing the opposing vertically extending frame member 3, these tubular members 16*a*, 16*b* being adapted to receive the bolt locking members 7*a* and 7*b* of the sliding bolt carriage handle members 8*a* and 8*b* respectively. The abovementioned intermediate gap 17 is configured to receive a tubular section 5 with a through bore 6 of the bolt receiving member 2 that is mounted onto the vertically extending frame member 3 when the vertically extending side of the sliding sash 4 is brought in abutment with the vertically extending frame member 3 whereby the tubular section 5 of the receiving member 2 is coaxially aligned with the pair of coaxially aligned tubular members 16*a*, 16*b* of the body portion 12 and, as the bolt locking members 7*a*, 7*b* are inserted within the through bore 6 of the tubular section 5, a locked condition of the lock assembly is being attained.

As shown in FIG. 3, the lock assembly of the invention comprises a pair of sliding bolt carriages 8*a* and 8*b*, each of the sliding bolt carriages 8*a* or 8*b* comprising a compact generally rectangular handle portion 31 with an opening 32 facilitating insertion of the hand of the user. Locking bolt members 7*a* and 7*b* are perpendicularly oriented at one end of the rectangular handle portion 31 of sliding bolt carriages 8*a* or 8*b* respectively, such locking bolt members being adapted to be inserted within the tubular members 16*a* and 16*b* and pass past these tubular members 16*a*, 16*b* within the central hole 6 of the frame mounted tubular receiving member 2, which fills the gap intermediately of the tubular members 16*a*, 16*b* when the lock assembly is brought at a locked condition.

A linear plate 33 extends at the other end of the rectangular handle portion 31 which is slidable within a lower channel 14*b* provided underneath channel 14*a* of the elongate profile member. The linear plate 33 further extends to an end button formation 34. When the sliding bolt carriage 8*a* or 8*b* moves back and forth, the button formation 34 is being engaged within either recession 27 or recession 28 of the guide block 18*a* or 18*b* respectively as will be described hereinafter.

Figure 4:
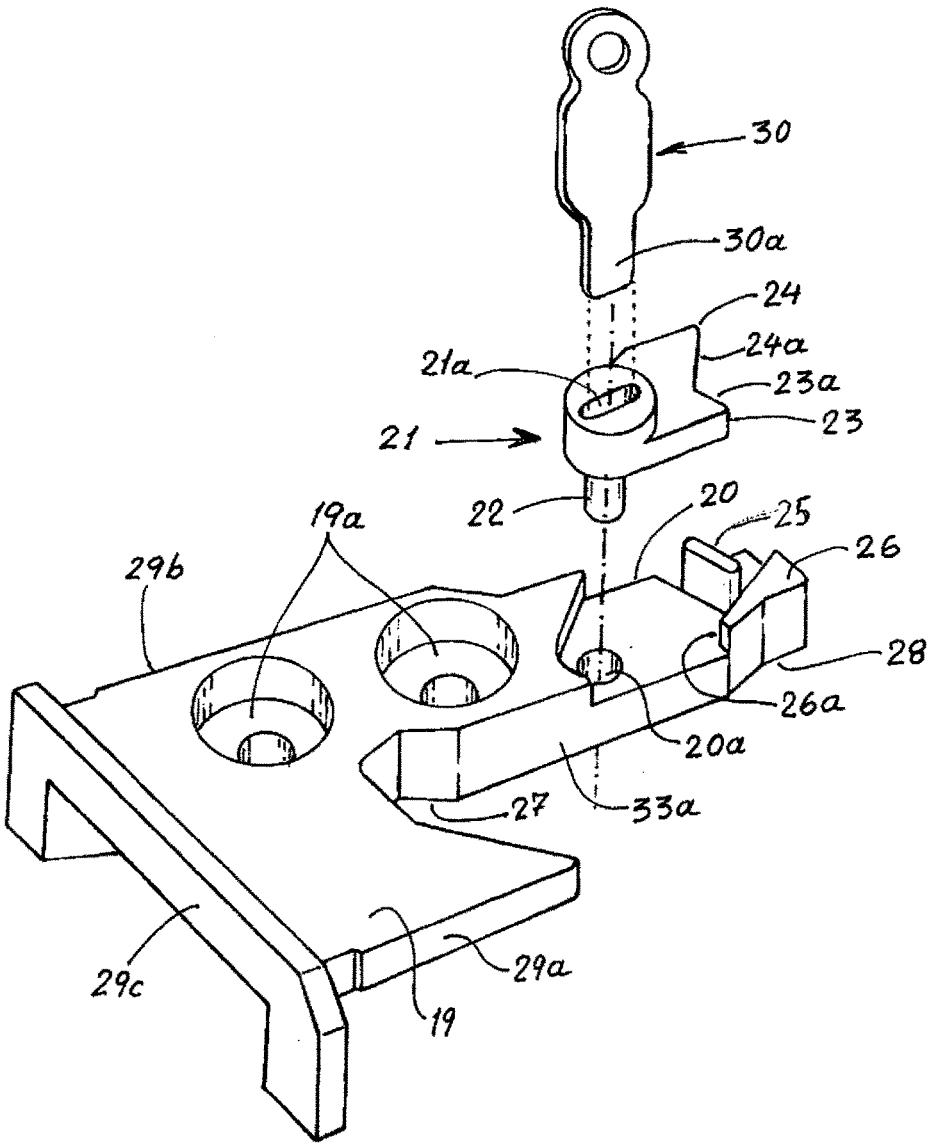
FIG. 4 shows in perspective an exploded view of one first guide block portion of one of the sliding bolt carriage handle members of the lock assembly, of a rotatable member of an immobilizer device appropriately mounted at a frontal end thereof and of a key adapted to effect rotation of the rotatable member in order to securely immobilize or release the associated sliding bolt carriage handle member of the lock assembly.

As shown in FIG. 4, each guide block 18*a* or 18*b* comprises a main body portion 19 with parallel lateral sides 29*a* and 29*b*, such lateral sides 29*a*, 29*b* being adapted to slide within the channels 14*a*, 15*a* of the body portion 12 as the guide blocks 18*a* and 18*b* are inserted within the elongate profile member of the body portion 12, whilst the main body portion 19 of the guide blocks abuts onto the base 13 of the elongate profile member. The main body portion 19 further comprises a flattened basement portion 29*c* which is thus sized as to be left outside the elongate profile member when the main body portion 19 is inserted therein. A pair of through holes 19*a* pass through the main body portion 19 of each guide block 18*a* or 18*b*, these holes 19*a* coinciding with the corresponding holes 13*a* of the base 13 of the elongate profile member when the guide blocks 18*a*, 18*b* are inserted therein and a pair of screws pass through these holes 19*a* of the guide blocks 18*a*, 18*b* and the corresponding holes 13*a* of the elongate profile member to fixedly mount the guide blocks 18*a*, 18*b* onto the base 13 of the elongate profile member and subsequently fixedly mount base 13 with the guide blocks 18*a*, 18*b* mounted thereupon onto an ergonomically appropriate position of the vertically extending side of the sliding sash 4. After the parallel lateral sides 29*a* and 29*b*, the main body portion 19 extends forwardly into an arm member with a lateral side 33*a*, such arm member having a width approximately half of the main body portion 19, whereby the aforementioned linear plate 33 of the sliding bolt carriage 8*a* and 8*b* reciprocatingly moves in abutment with this lateral side 33*a* of the guide block 18*a* and 18*b* respectively. The lateral side 33*a* is provided with a pair of front and rear recessions 28 and 27 respectively at the two ends thereof, such recessions being adapted to receive the aforementioned end button formations 34 of the linear plates 33 of sliding bolt carriages 8*a* and 8*b* when the bolt locking members are alternatively brought at a locked and an unlocked condition respectively.

Following the insertion of guide blocks 18*a*, 18*b* and sliding bolt carriages 8*a* and 8*b* into the elongate profile member of body portion 12 of the lock assembly, the open elongate profile member is covered by the covering plug 35 depicted in FIG. 3 that is provided with an elongate central recession 36 wherein the user places his fingers to grip and slide the sash 4 in a direction of rapprochement to the frame member 3 or in the opposite direction of displacing the sash to an opened condition. The covering plug 35 is provided with longitudinally extending fin members 37, which are adapted to snugly fit onto the lateral sides 14, 15 of the elongate profile member of body portion 12 of the lock assembly.

The lock assembly of the invention incorporates at least one immobilizer device for effecting immobilization of at least one of the locking bolt members 7*a*, 7*b* at a locked condition, such immobilizer device being devised through an appropriate configuration of the guide block 18*a* and/or 18*b* so that it may accomodate a rotatable member 21 that is alternatively set at a position to provide an immobilized condition of at least one of the bolt locking members 7*a*, 7*b* or a released condition of the same consequent to rotation of a key implement 30. FIG. 3 shows the guide block 18*a* incorporating such an immobilizing configuration whereas guide block 18*b* does not incorporate the same.

Figure 6:
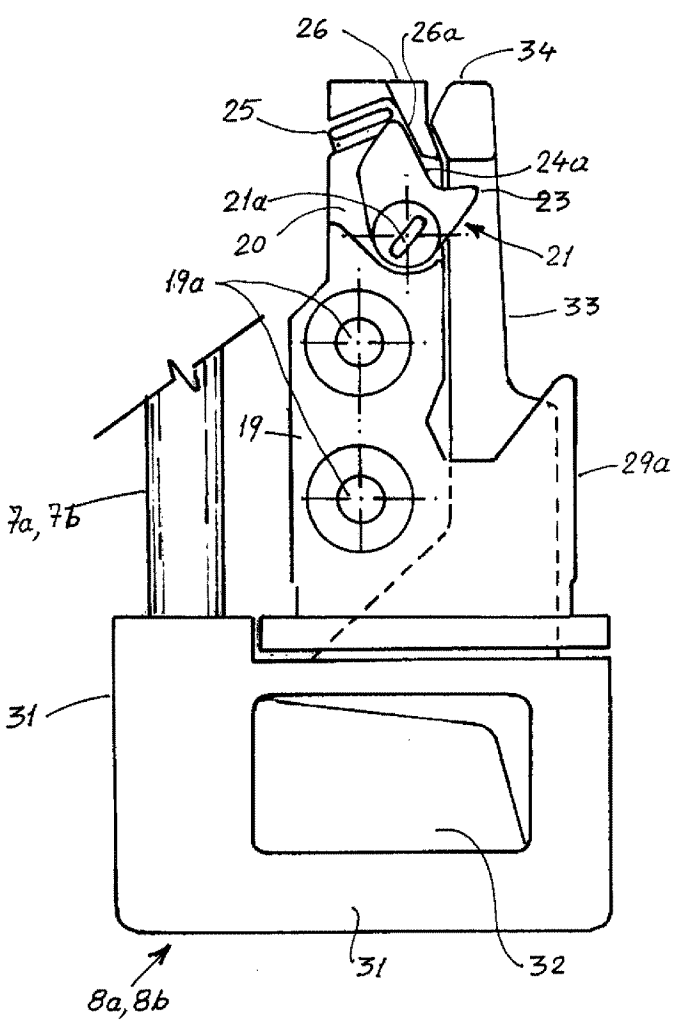
FIG. 6 shows the detail view of FIG. 5 with the rotatable member of the immobilizer device in locked condition.
Figure 5:
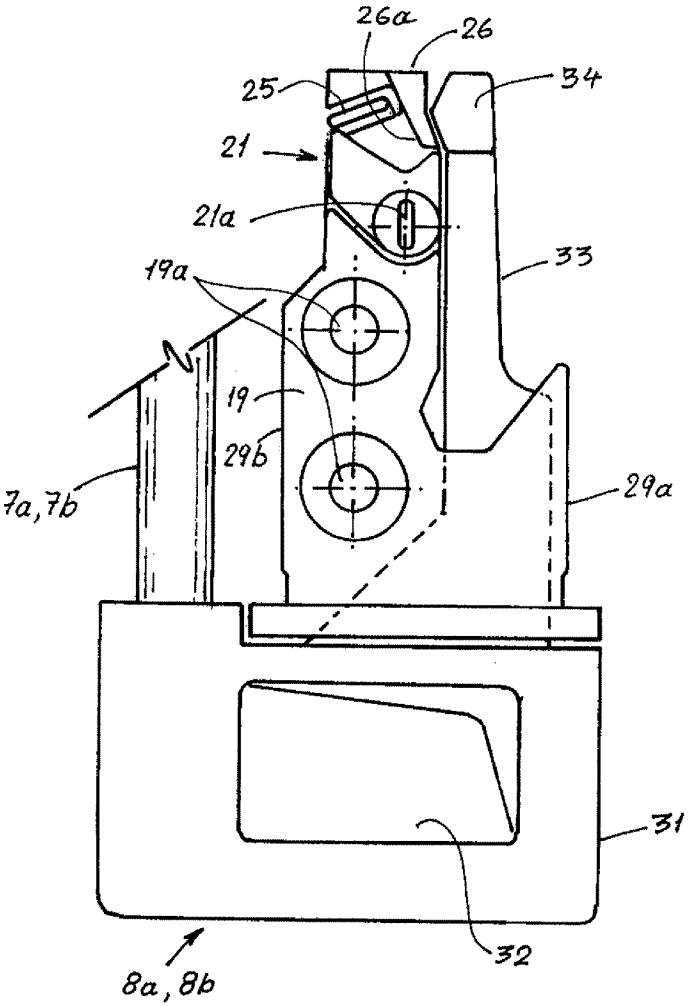
FIG. 5 shows a detail view of an unlocked condition of the rotatable member of the immobilizer device shown in FIG. 4 with the guide block portion shown in operative mode with the associated sliding bolt carriage handle member.

As shown in FIG. 4 a recessed region 20 is provided at a certain point of the lateral side 33*a* of the forwardly extending arm of the guide block 18*a*, such recessed region 20 being adapted to accommodate a rotatable immobilizer member 21 that is provided with an upper slot 21*a* adapted to receive an appropriately formed end 30*a* of a key implement 30 by means of which the immobilizer member 21 is rotated within a predetermined arc clockwise or counterclockwise to effect immobilization of bolt locking member 7*a* at a locked condition or release of the same. The immobilizer member 21 is provided with a V-section body extension with adjacent sides 23*a*, 24*a* and extreme edges 23 and 24 respectively and is further provided with a bottom extending shaft 22 that is adapted to enter into a hole 20*a* of the recessed region 20 and provide pivotal mounting of the immobilizer member 21 within the recessed region 20, whereby the immobilizer member 21 is flush with the surface of the body 19 of the guide block 18*a*. Past the immobilizer member 21, the lateral side 33*a* resumes the thickness of body 19 and extends at terminal ends, a first terminal end comprising a linear terminal section 25 that has been appropriately thinned through removal of plastic material in order to provide the flexibility of a spring means and a second terminal end being configured in a V-sectioned body portion 26. As the immobilizer member 21 rotates to a released condition, the abovementioned extreme edge 23 thereof abuts the linear terminal section 25, whilst the other extreme edge 24 abuts a bottom end of V-sectioned body portion 26 as shown in FIG. 5, whereby the bolt locking member is free to move through reciprocating movement of the sliding bolt carriage device 8*a*. As shown in FIG. 6, the immobilization function is activated and the bolt locking member 7*a* is immobilized when the immobilizer member 21 is rotated clockwise and side 24*a* of the V-section thereof terminates in abutment with an inner surface 26*a* of V-sectioned body portion 26, whilst an adjacent inner surface 23*a* of immobilizer member 21 extends underneath the end button formation 34 of linear plate 33 of the sliding bolt carriage device 8*a*, thereby averting movement of the latter and of the bolt locking member 7*a* thereof that is being maintained at a locked condition until the immobilizer member 21 is rotated anticlockwise in a released (idle) condition.

A hole 38 illustratively shown in FIG. 1 and in FIG. 2 is provided close to the upper and/or lower end of the covering plug 35 and the key implement 30 is adapted to enter through this hole 38 in order to enter into the underlying slot 21*a* and effect rotation of the immobilizer member 21 from an idle to an active condition and vice versa.

Whilst the hole 38 is depicted to be located at the proximity of locking bolt member 7*a* for a lock assembly that is adapted to provide immobilization of locking bolt member 7*a*, another embodiment might provide immobilization of locking bolt member 7*b* and another embodiment might provide immobilization of both locking bolt members 7*a* and 7*b*.

As shown in FIG. 3, the frame mounted locking bolt receiving member 2 that is employed in cooperation with external lock assembly 1 comprises a generally linear plate 9 that is being bent at right angles to form at the inner end thereof a plate 10 that is fixedly mounted onto the vertically extending post of frame member 3 by means of screws 11, whilst at the other end thereof, the linear plate 9 extends to the tubular section 5 with the through bore 6 that protrudes forwardly the frame member 3 and is being adapted to enter in the aforementioned gap 17 of tubular members 16*a*, 16*b* of the lock assembly 1 that is mounted onto the opposing vertically extending side of the sash 4.

The invention claimed is:

1. External lock assembly for a sliding door or window panel comprising a body member fixedly mounted onto a vertically extending side of the sliding door or window panel and provided with a pair of reciprocatingly moving locking bolt members, said lock assembly cooperating with a tubular bolt receiving member fixedly mounted onto an opposing vertically extending frame member, said body member of the lock assembly being an elongate profile member, rectilinear channels being provided along interior elongate lateral sides of the elongate profile member, locking mechanisms comprising sliding bolt carriage handle members and cooperating guide blocks being inserted within the elongate profile member, said guide blocks abutting a base of the elongate profile member and being fixedly mounted thereupon, said sliding bolt carriage handle members being provided with said locking bolt members extending at one end thereof and with linear plate members extending to end button formations at the other end thereof and being adapted to reciprocatingly slide within the rectilinear channels with said linear plate members in abutment with a lateral side of a body of said guide blocks to enable a locked or unlocked condition of the lock assembly as said end button formations of said linear plate members are engaged within recesses provided along said lateral side of the body of said guide blocks, a pair of coaxially aligned tubular members with an intermediate gap extending at one elongate side of the elongate profile member, said coaxially aligned tubular members being adapted to receive said bolt locking members extending at one end of the sliding bolt carriage handle members and said intermediate gap being configured to receive said tubular receiving member, said tubular receiving member being coaxially aligned with the pair of coaxially aligned tubular members of the elongate profile member whereby, consequent to a reciprocating movement of the sliding bolt carriage handle members, a locked condition of the lock assembly is being attained as the bolt locking members are inserted within said tubular receiving member, said lock assembly incorporating at least one immobilizer member for effecting immobilization of at least one of said pair of locking bolt members at a locked condition, said immobilizer member being accomodated within a recessed region of said guide block and being pivotally mounted with a shaft extension thereof into a hole of the recessed region of said guide block, said immobilizer member being provided with a V-section body extension with a first and a second adjacent sides extending to first and second extreme edges respectively, said guide block extending at a first terminal end comprising a linear terminal section being configured to provide flexibility of a spring means and a second terminal end being configured in a V-sectioned body portion, wherein as said immobilizer member rotates to a released condition, said second extreme edge thereof abuts said linear terminal section, whilst said first extreme edge thereof abuts a bottom end of said V-sectioned body portion, whereby the bolt locking member is free to move through reciprocating movement of the sliding bolt carriage handle member and as said immobilizer member rotates to an activated condition, said first side of the V-section thereof terminates in abutment with an inner surface of said V-sectioned body portion, whilst said second side thereof extends underneath the end button formation of the linear plate of the sliding bolt carriage handle member, thereby averting movement of the sliding bolt carriage handle member and of the bolt locking member thereof.

2. The external lock assembly for a sliding door or window panel of claim 1, wherein said at least one immobilizer member is provided with a slot adapted to receive a key implement by means of which said immobilizer member may be alternatively rotated in an activated postion thereby averting movement of said sliding bolt carriage handle member and of said bolt locking member thereof or in a released condition thereby allowing free movement of said sliding bolt carriage handle member and of said bolt locking member thereof.

3. The external lock assembly for a sliding door or window panel of claim 2, wherein a covering plug of said elongate profile member of the lock assembly is provided with a hole located proximally to the locking bolt member being immobilized by said immobilizer member, said hole being oriented above an underlying slot of the immobilizer member and being adapted to receive said key implement to allow insertion thereof into said underlying slot in order to effect rotation of the immobilizer member from an activated position of immobilization of said sliding bolt carriage handle member and of said bolt locking member thereof to a released position of allowance of free movement of said sliding bolt carriage handle member and of said bolt locking member thereof.

* * * * *